US009488431B2

(12) United States Patent
Bubits

(10) Patent No.: US 9,488,431 B2
(45) **Date of Patent: *Nov. 8, 2016**

(54) PISTOL WITH BARREL LOCKING DEVICE

(71) Applicant: Merkel Jagd- & Sportwaffen GmbH, Suhl (DE)

(72) Inventor: Wilhelm Bubits, Lutzmannsburg (AT)

(73) Assignee: MERKEL JAGD— & SPORTWAFFEN GMBH, Suhl (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/462,037

(22) Filed: Aug. 18, 2014

(65) Prior Publication Data

US 2014/0352187 A1 Dec. 4, 2014

Related U.S. Application Data

(63) Continuation of application No. 13/594,131, filed on Aug. 24, 2012, now Pat. No. 8,807,010.

(30) Foreign Application Priority Data

Aug. 24, 2011 (AT) ..... A 1212/2011

(51) Int. Cl.
*F41C 3/00* (2006.01)
*F41A 3/00* (2006.01)
(Continued)

(52) U.S. Cl.
CPC . *F41C 3/00* (2013.01); *F41A 3/00* (2013.01); *F41A 3/44* (2013.01); *F41A 21/488* (2013.01); *Y10T 29/49826* (2015.01)

(58) Field of Classification Search
CPC ..... F41A 3/36; F41A 3/44; F41A 3/46; F41A 3/38; F41A 21/488; F41A 21/48; F41A 21/484
USPC ..... 89/196, 145, 180, 182, 183, 187.01, 89/187.02, 194, 195, 198, 199, 4.2, 24; 42/7
See application file for complete search history.

(56) References Cited

U.S. PATENT DOCUMENTS 2,089,671 A 8/1937 Stecke
2,396,564 A 3/1946 Gal
(Continued)

FOREIGN PATENT DOCUMENTS

AT 403 847 B 5/1998
AT 510291 B1 3/2012
(Continued)

OTHER PUBLICATIONS

AT 403847 English Translation of Abstract.
(Continued)

*Primary Examiner* — John D Cooper
(74) *Attorney, Agent, or Firm* — Cantor Colburn LLP

(57) ABSTRACT

A method of locking a barrel of a firearm with respect to a barrel slide is provided. The method including the steps of: movably mounting a barrel slide to a housing of the firearm; movably mounting a barrel to the barrel slide; movably mounting a pair of locking bodies in a transverse groove of a head of the barrel; and securing a locking block to the housing, wherein movement of the head of the barrel with respect to the locking block in a longitudinal direction causes the barrel to be locked to the barrel slide, wherein the pair of locking bodies engage recesses on the barrel slide when the barrel is locked to the barrel slide, wherein the locking block has two first wedge surfaces which are symmetrical about a longitudinal center plane and the locking bodies are elongated cylinders, the circumferential surface of which has two parallel planar guide surfaces resting in the transverse groove, a second wedge surface which faces the other locking body and interacts with the first wedge surfaces of the locking block, and an engagement surface which faces away from the other locking body in each case and is intended for engaging in the respective recess of the barrel slide when the barrel is locked to the barrel slide.

17 Claims, 5 Drawing Sheets

(51) Int. Cl.
*F41A 3/44* (2006.01)
*F41A 21/48* (2006.01)

(56) References Cited

U.S. PATENT DOCUMENTS

| | | | | |
|---|---|---|---|---|
| 2,651,974 | A | 9/1953 | Simpson | |
| 2,921,502 | A | 1/1960 | Amsler | |
| 2,948,195 | A | 8/1960 | Linder | |
| 3,282,166 | A | 11/1966 | Bernard | |
| 3,738,219 | A | 6/1973 | Febres | |
| 3,848,510 | A | 11/1974 | Wolpert | |
| 3,979,997 | A | 9/1976 | Khaidurov | |
| 4,135,434 | A * | 1/1979 | Hurlemann | F41A 3/46 89/181 |
| 4,194,433 | A | 3/1980 | Zellweger | |
| 4,240,325 | A | 12/1980 | Hurlemann | |
| 4,915,011 | A | 4/1990 | Smith | |
| 5,138,930 | A | 8/1992 | Simon | |
| 5,275,084 | A | 1/1994 | Ruger | |
| 5,309,815 | A | 5/1994 | Welde | |
| 5,581,046 | A | 12/1996 | Weldle | |
| 5,682,007 | A | 10/1997 | Dobbins | |
| 5,900,576 | A * | 5/1999 | Gabriel | F41A 3/46 89/187.01 |
| 6,079,138 | A | 6/2000 | Meaker | |
| 6,260,301 | B1 | 7/2001 | Aigner | |
| 6,276,256 | B1 * | 8/2001 | Kimmig | F41A 3/34 89/186 |
| 6,564,491 | B2 | 5/2003 | Murello | |
| 6,655,065 | B1 | 12/2003 | Chapman | |
| 6,715,399 | B2 | 4/2004 | Barrett, Jr. | |
| 7,237,469 | B2 | 7/2007 | Murello | |
| 7,287,456 | B2 | 10/2007 | Spielberger | |
| 7,571,671 | B2 | 8/2009 | Engel | |
| 7,735,411 | B2 | 6/2010 | Bubits | |
| 7,770,507 | B1 | 8/2010 | Hajjar | |
| 8,096,074 | B2 | 1/2012 | Robinson | |
| 2003/0150322 | A1 | 8/2003 | Barrett | |
| 2003/0183068 | A1 | 10/2003 | LaFleur | |
| 2004/0007124 | A1 | 1/2004 | Nakatani | |
| 2006/0101990 | A1 | 5/2006 | McGarry | |
| 2007/0012170 | A1 | 1/2007 | Spielberger | |
| 2007/0256344 | A1 * | 11/2007 | Bubits | F41A 3/40 42/7 |
| 2010/0275491 | A1 | 11/2010 | Leiter | |
| 2011/0185885 | A1 | 8/2011 | Zimmerman | |

FOREIGN PATENT DOCUMENTS

| | | | |
|---|---|---|---|
| DE | 3142350 | A1 | 5/1983 |
| DE | 19645681 | A | 5/1998 |
| DE | 19843591 | A | 4/2000 |
| DE | 202008005898 | U1 | 10/2008 |
| DE | 1535012 | EP | 2/2009 |
| DE | 10108710 | A | 1/2011 |
| EP | 511902 | B1 | 7/1997 |
| EP | 973002 | A3 | 8/2000 |
| FI | 119659 | B1 | 1/2009 |
| GB | 135383 | A | 11/1919 |
| GB | 507861 | A | 6/1939 |
| GB | 507875 | A | 6/1939 |
| GB | 668117 | A | 3/1952 |
| GB | 734762 | A | 8/1955 |
| GB | 875257 | A | 8/1961 |
| GB | 878668 | A | 10/1961 |
| GB | 1567959 | A | 5/1980 |
| JP | 4860983 | B2 | 1/2012 |
| RU | 2089818 | C1 | 9/1997 |
| RU | 2138001 | C1 | 9/1999 |
| RU | 2156938 | C1 | 9/2000 |
| RU | 2186316 | C1 | 7/2002 |
| SU | 1787256 | A3 | 1/1993 |
| WO | 2007090219 | A1 | 8/2007 |

OTHER PUBLICATIONS

GB 668117 English Translation of Abstract.

International Search Report for International Application No. PCT/AT2012/000219.

Small Arms of the World; German World War II Small Arms; by Edward Clinton Ezell; pp. 371 & 530-535.

* cited by examiner

PISTOL WITH BARREL LOCKING DEVICE

CROSS-REFERENCED TO RELATED APPLICATIONS

This application is a continuation of U.S. patent application Ser. No. 13/594,131 filed Aug. 24, 2012, which claims the benefit, in accordance with 35 U.S.C. §119 (a), of Austrian Patent Application Serial No. A1212/2011, filed on Aug. 24, 2011, the contents each of which are incorporated herein by reference thereto.

FIELD OF THE INVENTION

The invention relates to pistols, with a housing, a barrel slide which is guided displaceably in the longitudinal direction thereon, a barrel which is guided displaceably in the barrel slide, and a barrel locking device which is formed by the head of the barrel. In particular, the invention relates to a barrel locking device for locking the barrel to the barrel slide. More particularly, the invention relates to a locking device having a locking block and a pair of locking bodies which are guided in a transverse groove in the head of the barrel and that engage in recesses on the inside of the barrel slide by action of the locking block and thus lock the barrel to the barrel slide.

BACKGROUND OF THE INVENTION

In the majority of pistols, locking takes place by tilting and rotating the barrel with respect to the barrel slide. The resultant mass forces impair the handling and therefore the security of fire. This disadvantage does not occur in the case of locking by means of locking bodies which are generally circular-cylindrical rollers. Nevertheless, this type of locking has not found widespread use.

A pistol of the type in question is known from Great Britain Patent No. GB 668,117. The locking bodies disclosed in GB 668,117 are circular-cylindrical rollers which bear against planar boundary surfaces of the transverse groove and thereby transmit the reaction force of the barrel to the barrel slide in the event of a shot. Linear contact prevails between the planar boundary surfaces and the circular-cylindrical rollers. The linear contact generates a high surface pressure (referred to as Hertzian stress) in both parts. Linear contact also prevails between the rollers and the connecting link of the locking block. It has been demonstrated that this high local surface pressure on all three parts, but especially on the parts positioned within the transverse groove, results in deformations which may cause fracturing. A further difficulty in the case of the pistol according to GB 668,117 is that the rollers have a narrowing configuration, and therefore the contact line is shorter than the height of the rollers. This type of locking is therefore not suitable for large caliber cartridges or cartridges having high gas pressures.

It has indeed been attempted to harden the parts concerned in such a manner that they withstand high surface pressures. Local inductive hardening has not been tried and tested in this case because it is too complicated and is not reliable, and cracking may occur at the transition from the hardened zone into the unhardened zone. These disadvantages do not occur in the case of gas nitriding because of the limited hardness depth of approximately 0.35 mm, but with linear contact, deformation cannot be avoided in the unhardened zone located therebelow.

It is therefore an object of the invention to design the locking in a pistol of the type in question in such a manner that the above-described disadvantages do not occur. The peak values of the local surface pressure are intended to be reduced such that the pistol is also suitable for normal to large calibers and even for high-explosive munition.

SUMMARY OF THE INVENTION

The present invention provides a pistol with a housing, a barrel slide which is guided displaceably in the longitudinal direction thereon, a barrel which is guided in the barrel slide, and a locking device for locking the barrel to the barrel slide. The locking device is formed by a head of the barrel, a locking block secured in the longitudinal direction, and a pair of locking bodies guided in a transverse groove of the head of the barrel. The locking bodies engage in recesses on the inside of the barrel slide by the action of the locking block and thus lock the barrel to the barrel slide. The locking block has two first wedge surfaces which are symmetrical about a longitudinal center plane. The locking bodies are elongated cylinders, the circumferential surface of which has two parallel planar guide surfaces resting in the transverse groove, a second wedge surface which faces the other locking body and interacts in a sheetlike manner with the first wedge surfaces of the locking block, and an engagement surface which faces away from the other locking body and is intended for engaging in the respective recess of the barrel slide.

In another embodiment, a method of locking a barrel of a firearm with respect to a barrel slide is provided. The method including the steps of: movably mounting a barrel slide to a housing of the firearm; movably mounting a barrel to the barrel slide; movably mounting a pair of locking bodies in a transverse groove of a head of the barrel; and securing a locking block to the housing, wherein movement of the head of the barrel in a longitudinal direction with respect to the locking block causes the barrel to be locked to the barrel slide, wherein the pair of locking bodies engage recesses on the barrel slide when the barrel is locked to the barrel slide, wherein the locking block has two first wedge surfaces which are symmetrical about a longitudinal center plane and the locking bodies are elongated cylinders, the circumferential surface of which has two parallel planar guide surfaces resting in the transverse groove, a second wedge surface which faces the other locking body and interacts with the first wedge surfaces of the locking block, and an engagement surface which faces away from the other locking body in each case and is intended for engaging in the respective recess of the barrel slide when the barrel is locked to the barrel slide.

In yet another embodiment, a firearm is provided. The firearm having: a housing; a barrel slide movably mounted to the housing for longitudinal movement with respect to the housing; a barrel movably mounted to the barrel slide for longitudinal movement with respect to the barrel slide; a locking device for locking the barrel to the barrel slide, the locking device comprising: a head mounted to the barrel, a locking block secured in the longitudinal direction and a pair of locking bodies guided in a transverse groove of the head, wherein the locking bodies engage recesses on a surface of the barrel slide when the barrel is locked to the barrel slide, wherein the locking block has two first wedge surfaces which are symmetrical about a longitudinal center plane and the locking bodies are elongated cylinders, the circumferential surface of which has two parallel planar guide surfaces resting in the transverse groove, a second wedge surface which faces the other locking body in each case and interacts with the first wedge surfaces of the locking block, and an engagement surface which faces away from the other locking body in each case and is intended for engaging in the respective recess of the barrel slide, wherein movement of the barrel with respect to the locking block causes the locking bodies to engages the recesses of the barrel slide.

BRIEF DESCRIPTION OF THE DRAWINGS

The invention is described and explained below with reference to figures, in which.

DETAILED DESCRIPTION OF THE PREFERRED EMBODIMENTS

Figure 1:
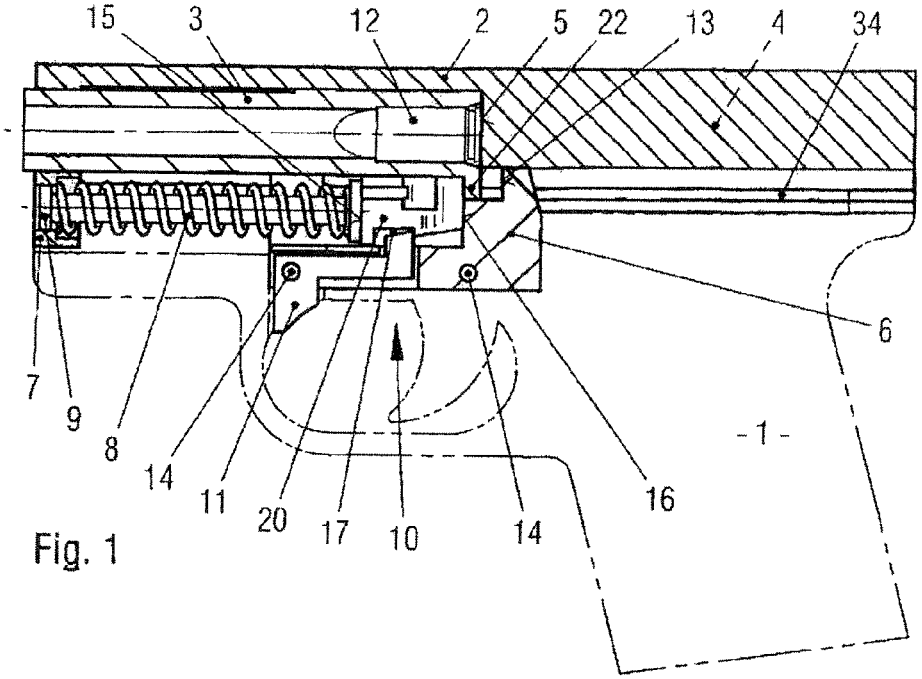
FIG. 1 illustrates a vertical longitudinal section through a pistol according to the invention.

A pistol in accordance with the present invention includes a housing, a barrel slide which is guided displaceably in the longitudinal direction thereon, a barrel which is guided displaceably in the barrel slide, and a barrel locking device which is formed by the head of the barrel. The barrel locking device includes a locking block and a pair of locking bodies which are guided in a transverse groove in the head of the barrel and engage in recesses on the inside of the barrel slide by action of the locking block and thus lock the barrel to the barrel slide.

The locking bodies are elongated cylinders wherein the circumferential surface of each locking body has two planar guide surfaces resting in the transverse groove in the head of the barrel. Each locking body has a first wedge surface facing the other locking body, and an engagement surface which faces away from the other locking body and is intended for engagement in the respective recess of the barrel slide. The locking block has two wedge surfaces which are symmetrical about a longitudinal central plane and interact in a sheetlike manner with the first wedge surfaces of the locking bodies.

The guide surfaces of the locking bodies bear extensively against the walls of the transverse groove which significantly reduces the surface pressure and avoids local peak values. Because the locking bodies are elongated in the direction of the transverse groove, the contact surface thereof is also considerable in this direction. Planar wedge surfaces act with the same pressure-reducing effect between the locking bodies and the locking block. As a result, all of the line contacts are therefore replaced by surface contacts. This advantageous type of locking can therefore also be used for normal to large calibers and high-explosive munition.

Favorable force and friction ratios prevail when the first and the second planar wedge surface of each locking body enclose an angle with the longitudinal central plane; 45 degrees is optimum.

In one embodiment, the engagement surface of the locking body and the recess in the barrel slide may be substantially circular-cylindrical. In another embodiment, the engagement surface of the locking body and the recess in the barrel slide form a circular-cylindrical zone and of an inclined, in particular planar, zone tangentially adjoining the front side of the engagement surface. This reduces the friction during the release. For the inclined zone of the engagement surface, an angle with respect to the longitudinal direction is advantageous; 45 degrees is likewise optimum.

In one embodiment, the head of the barrel is guided on both sides by means of first grooves and first rails in the barrel slide, and by means of second grooves and second rails in the locking block. The locking block is secured on the lower side thereof, which faces away from the head, in the longitudinal direction in relation to the housing by means of a second transverse groove. This ensures a defined assignment in the vertical direction of the components involved in the locking and makes it possible to slightly adjust the locking block in the transverse direction. As a result, a uniform distribution of the forces acting on the two locking bodies is ensured.

In another embodiment, on the lower side of the locking body second wedge surfaces, which side faces away from the head of the barrel, the locking block forms a horizontal plate which partially overlaps the locking bodies. The plate secures the locking bodies in the transverse groove which is also advantageous during the assembly of the pistol. As a result, the entire height of the locking body is therefore available for the guide surfaces.

The locking system of the present invention also is capable for use in rifles and machine guns.

Referring now to FIG. 1, the housing of a pistol according to the invention is indicated by dashed lines and denoted by 1. The section through the parts relevant to the invention in the longitudinal central plane can be seen with a solid line. A barrel slide 2 is guided displaceably in the longitudinal direction in guides 34 on the housing 1. A barrel 3 is guided displaceably in the longitudinal direction in the barrel slide 2. At the front end thereof, the barrel slide 2 forms a center rest 7 through which the barrel 3 passes and on which a closing spring 8 containing a closing spring rod 9 engages below the barrel 3. Behind the cartridge or cartridge chamber 12 of the barrel 3, an impact base 5 is formed in the barrel slide 2 and is adjoined by a firing device 4. The firing device is not illustrated since it is not essential to the invention.

A guide block 6 is fastened in the housing 1 by means of pins 14 or the like. The guide block 6 forms a stop 13 for the returning barrel 3. The locking device is denoted overall by 10. That part of the locking device 10 which is fixed on the housing 1 is a locking block 20 which is held in the longitudinal direction with respect to the housing 1 by a bolt 11. The front surface 15 of the locking block 20 forms the abutment for the closing spring 8, and the rear surface 16 of the locking block 20 is supported on the guide block 6. The bolt 11 is designed here as a disassembly lever and is pivotable about one of the pins 14.

Figure 2:
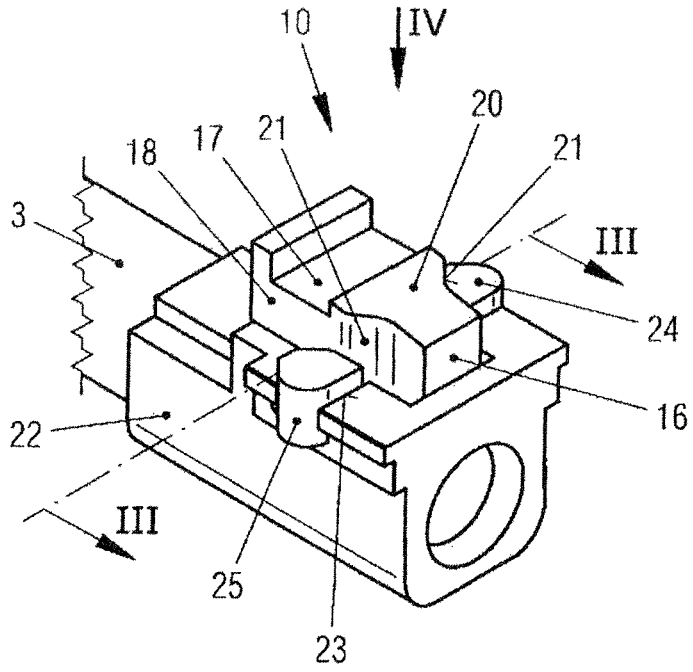
FIG. 2 illustrates an axonometric view of a locking device according to the present invention obliquely from below.
Figure 3:
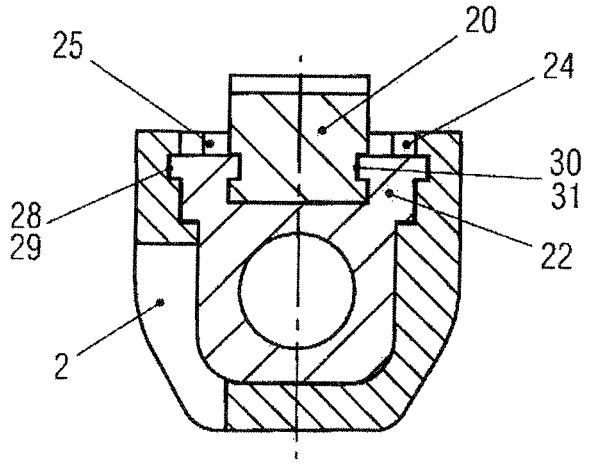
FIG. 3 illustrates a cross section according to III-III in FIG. 2.

FIGS. 2 and 3 show the locking device 10 according to the invention in an oblique view and in the longitudinal direction turned through 180 degrees omitting the components which are not directly involved in the locking. For fixing in the longitudinal direction with respect to the housing 1, the lower side of the locking block 20 (at the top in FIGS. 2 and 3) has a retaining groove 17 in which the bolt 11 (see FIG. 1) engages. The locking block 20 has two wedge surfaces, first wedge surfaces 21, that run symmetrically with respect to the longitudinal central plane. The locking block 20 also has side walls 18 along the longitudinal direction of said locking block 20. The rear part of the barrel 3 forms a barrel head 22 with a transverse groove 23 on the lower side thereof. A locking body 24, 25 is guided in the transverse direction on both sides in the transverse groove 23.

The head 22 of the barrel 3 is guided in the longitudinal direction by means of first grooves 28 and first rails 29 in the barrel slide 2 and by means of second grooves 30 and second rails 31 on the locking block 20. While the barrel slide 2 having first grooves 28 and first rails 29, and the locking block 20 having second grooves 30 and second rails 31, has been shown and described, the present invention is not limited in this regard as the groove and rail can each be arranged in either one or the other of the components.

Figure 4:
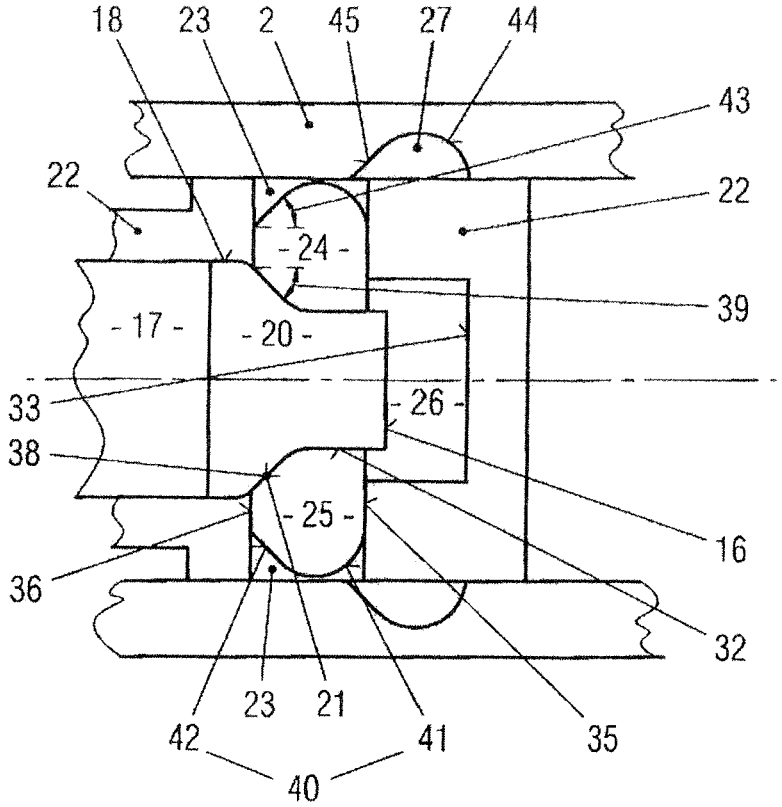
FIG. 4 illustrates an enlarged view according to IV in FIG. 2.

FIG. 4 provides an enlarged plan view of the components of FIG. 2, namely, the locking block 20 fixed on the housing 1, the head 22 of the displaceable barrel 3, the locking bodies 24, 25 which are displaceable in the transverse groove 23, and the barrel slide 2 having recesses 27 formed therein corresponding to the locking bodies 24, 25.

The locking block 20 has first wedge surfaces 21 which are symmetrical with respect to the longitudinal central plane, converge to the rear from the side walls 18 of said locking block 20 and are at an angle 39, preferably at 45 degrees, with respect to the longitudinal direction. The first wedge surfaces 21 are adjoined by parallel latching surfaces 32 along, and as far as the rear end of, the locking block 20.

On the lower side thereof (at the top in the FIG. 4), the head 22 of the barrel 3 has a transverse groove 23 which forms straight planar vertical surfaces for guiding the locking bodies 24, 25. Considerable forces are input by the locking bodies 24, 25 via said surfaces, wherein, owing to the surface contact according to the invention, the surface pressure does not assume any excessive peak values. The transverse groove 23 is interrupted by a central elongated channel 26 in which the locking block 20 is guided. The channel 26 is bounded at the rear end thereof (on the right in FIG. 4) by a transverse surface 33 of the head 22 of the barrel 3. Transverse surface 33 serves as a stop against the rear surface 16 of the locking block 20 in the locked position.

The locking bodies 24, 25 are elongated cylinders, the circumferential surface of which is not circular but rather is composed of a first guide surface 35, a second guide surface 36 which is substantially parallel thereto, a second wedge surface 38, and an engagement surface 40. There is an angle 39 between the second wedge surface 38 and the longitudinal direction, said angle preferably being 45 degrees. The engagement surface 40, for its part, may differ in design; in the embodiment shown, it consists of a circular-cylindrical zone 41 and an inclined, for example planar, transition zone 42. The inclined transition zone 42 is a plane which encloses an angle 43 with the longitudinal direction, said angle preferably being 45 degrees.

The barrel slide 2, on the inside of the slide walls thereof, has recesses 27 on both sides, which recesses interact with the locking bodies 24, 25. The recesses 27 have a shape corresponding to the engagement surfaces 40 of the locking bodies 24, 25. It consists here of a circular-cylindrical zone 44 and an inclined, for example planar, transition zone 45. The transition zone 45 may be planar, but does not have to be. At an appropriate angle 43, the transition zone 45 reduces the force and friction required for release purposes.

Figure 5:
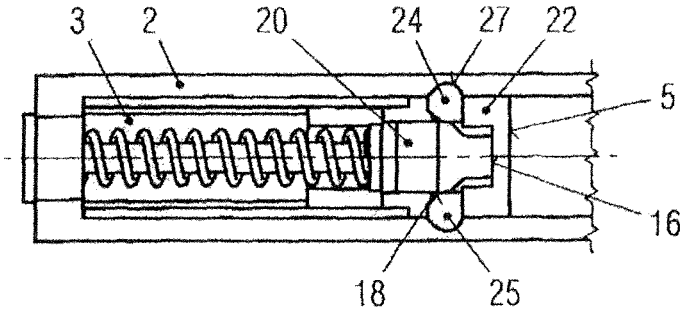
FIG. 5 illustrates the pistol in a first operating position as seen from below.
Figure 6:
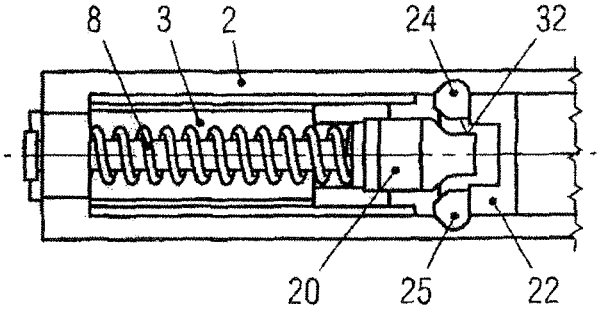
FIG. 6 illustrates the same as FIG. 5, in a second operating position.
Figure 7:
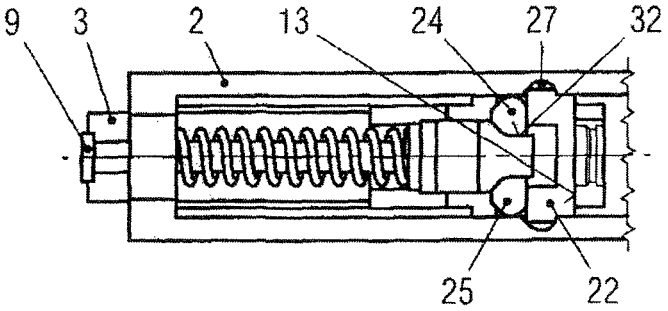
FIG. 7 illustrates the same as FIG. 5, in a third operating position.

FIGS. 5, 6 and 7 show three different operating positions of the locking device 10, with reference to which the operation will now be explained.

FIG. 5 shows the device locked and ready for firing. The barrel slide 2 and the barrel 3 are in their frontmost position. In this position, the head 22 of the barrel 3 bears against the impact base 5, and the rear surface 16 of the locking block 20 bears against the head 22 of the barrel 3. The locking bodies 24, 25 are latched into the recesses 27 in the barrel slide 2 and are held in this position by the side walls 18 of the locking block 20.

When a shot is discharged, as shown in FIG. 6, the barrel slide 2 and barrel 3 are first pushed back counter to the force of the closing spring 8. The locking block 20 does not change its position with respect to the housing 1. As a result, the locking bodies 24, 25 lie further to the rear with respect to the locking block 20. The locking bodies 24, 25 are no longer secured by the side walls 18 of the locking block 20 in the recesses 27 of the barrel slide. The latching surfaces 32 of the locking block 20 are now located between the locking bodies 24, 25; and the distance of the latching surfaces 32 from each other is smaller than that between the side walls 18. The locking bodies 24, 25 can therefore deviate inward with respect to each other.

As shown in FIG. 7, the common return of the barrel slide 2 and barrel 3 ends when the head 22 of the barrel 3 strikes against the stop 13 of the guide block 6 and is at a standstill. Then, only the barrel slide 2 continues to move further backwards. By means of the relative movement between the barrel slide 2 and barrel 3, the locking bodies 24, 25 are pressed inward by the transition zones 45 of the recesses 27 in the barrel slide 2 until the locking bodies 24, 25 bear against the latching surfaces 32 of the locking block 20. The released position shown in FIG. 7 coincides with the enlarged illustration shown in FIG. 4.

Upon continued return of the barrel slide 2, the cartridge 12 is ejected in a known manner and the firing device 4 (not shown) is tensioned. If the barrel slide 2 moves forward after a reversal in movement, the positions of the locking device 10 shown in FIGS. 5, 6 and 7 are passed through in a reverse sequence.

Figure 8:
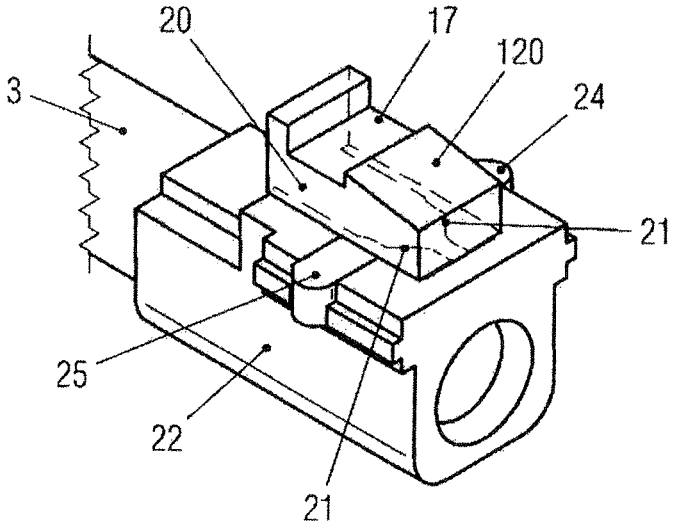
FIG. 8 illustrates an alternative to FIG. 2.

FIG. 8 shows another embodiment of a locking device of the present invention wherein the locking block 20 forms a plate 120 over the first wedge surfaces 21 (depicted in dashed lines). The plate 120 partially overlaps the locking bodies 24, 25 such that the locking bodies 24, 25 cannot drop out of the transverse groove 23.

Although this invention has been shown and described with respect to the detailed embodiments thereof, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A method of locking a barrel of a firearm with respect to a barrel slide, comprising:

movably mounting a barrel slide to a housing of the firearm;

movably mounting a barrel to the barrel slide;

movably mounting a pair of locking bodies in a transverse groove of a head of the barrel; and securing a locking block to the housing, wherein movement of the head of the barrel with respect to the locking block in a longitudinal direction causes the barrel to be locked to the barrel slide, wherein the pair of locking bodies engage recesses on the barrel slide when the barrel is locked to the barrel slide, wherein the locking block has two first wedge surfaces which are symmetrical about a longitudinal center plane and the locking bodies are elongated cylinders, the circumferential surface of which has two parallel planar guide surfaces resting in the transverse groove, a second wedge surface which faces the other locking body and interacts with the first wedge surfaces of the locking block, and an engagement surface which faces away from the other locking body in each case and is intended for engaging in the respective recess of the barrel slide when the barrel is locked to the barrel slide.

2. The method as in claim 1, wherein the first wedge surface of the locking block and the second wedge surface of the locking body each comprise a corresponding angle in relation to the longitudinal center plane.

3. The method as in claim 1, wherein the engagement surface of the locking bodies has a substantially cylindrical zone and, tangentially adjoining the front side, an inclined transition zone, and the recess in the barrel slide has a substantially cylindrical zone and, tangentially adjoining the front side, an inclined transition zone.

4. The method as in claim 3, wherein the inclined transition zone of the engagement surface and the inclined transition zone of the recess each comprise a corresponding angle in relation to the longitudinal direction.

5. The method as in claim 1, wherein the head of the barrel is guided on both sides by first grooves and first rails in the barrel slide and second grooves and second rails in the locking block, and wherein the locking block is secured on a lower side thereof, which faces away from the head, by means a retaining groove.

6. The method as in claim 1, wherein the locking block has a horizontal plate on a lower side thereof, which side faces away from the head of the barrel, that partially overlaps the locking bodies.

7. The method as in claim 1, wherein the firearm is a pistol.

8. The method as in claim 1, wherein the firearm is a machine gun.

9. A firearm, comprising:

a housing;

a barrel slide movably mounted to the housing for longitudinal movement with respect to the housing;

a barrel movably mounted to the barrel slide for longitudinal movement with respect to the barrel slide;

a locking device for locking the barrel to the barrel slide, the locking device comprising: a head mounted to the barrel, a locking block secured in the longitudinal direction and a pair of locking bodies guided in a transverse groove of the head, wherein the locking bodies engage recesses on a surface of the barrel slide when the barrel is locked to the barrel slide, wherein the locking block has two first wedge surfaces which are symmetrical about a longitudinal center plane and the locking bodies are elongated cylinders, the circumferential surface of which has two parallel planar guide surfaces resting in the transverse groove, a second wedge surface which faces the other locking body in each case and interacts with the first wedge surfaces of the locking block, and an engagement surface which faces away from the other locking body in each case and is intended for engaging in the respective recess of the barrel slide, wherein movement of the barrel with respect to the locking block causes the locking bodies to engages the recesses of the barrel slide.

10. The firearm as in claim 9, wherein the locking block further comprises a plate configured to prevent the locking bodies from falling downwardly out of the transverse groove.

11. The firearm as in claim 9, wherein the locking block engages a bottom surface of the head of the barrel.

12. The firearm as in claim 9, wherein the firearm is a pistol.

13. The firearm as in claim 9, wherein the firearm is a machine gun.

14. The firearm as in claim 9, wherein the first wedge surface of the locking block and the second wedge surface of the locking body each comprise a corresponding angle in relation to the longitudinal center plane.

15. The firearm as in claim 9, wherein the engagement surface of the locking bodies has a substantially cylindrical zone and, tangentially adjoining the front side, an inclined transition zone, and the recess in the barrel slide has a substantially cylindrical zone and, tangentially adjoining the front side, an inclined transition zone.

16. The firearm as in claim 15, wherein the inclined transition zone of the engagement surface and the inclined transition zone of the recess each comprise a corresponding angle in relation to a longitudinal direction.

17. The firearm as in claim 9, wherein the head of the barrel is guided on both sides by first grooves and first rails in the barrel slide and second grooves and second rails of the locking block, and wherein the locking block is secured to the housing on a lower side thereof, which faces away from the head by a retaining groove.

* * * * *